US010547154B2

(12) United States Patent
Wu et al.

(10) Patent No.: US 10,547,154 B2
(45) Date of Patent: Jan. 28, 2020

(54) MANUFACTURING METHOD FOR ELECTRICAL CONNECTOR

(71) Applicant: Drapho Electronics Technology Co, Ltd, Kunshan, Jiangsu Province (CN)

(72) Inventors: Zhuping Wu, Kunshan (CN); Yun Zhu, Kunshan (CN); Zhihong Fang, Kunshan (CN); Tadashi Kosuga, Kunshan (CN); Yuhua Mao, Kunshan (CN)

(73) Assignee: DRAPHO ELECTRONICS TECHNOLOGY CO, LTD, Kunshan, Jiangsu Province (CN)

( * ) Notice: Subject to any disclaimer, the term of this patent is extended or adjusted under 35 U.S.C. 154(b) by 284 days.

(21) Appl. No.: 15/393,846

(22) Filed: Dec. 29, 2016

(65) Prior Publication Data

US 2017/0294753 A1 Oct. 12, 2017

(30) Foreign Application Priority Data

Apr. 8, 2016 (CN) ..... 2016 1 0214757

(51) Int. Cl.
*H01R 43/16* (2006.01)
*H01R 43/24* (2006.01)

(52) U.S. Cl.
CPC ..... *H01R 43/16* (2013.01); *H01R 43/24* (2013.01)

(58) Field of Classification Search
CPC ..... H01R 43/04; H01R 43/16; H01R 43/24
See application file for complete search history.

(56) References Cited

U.S. PATENT DOCUMENTS 4,404,264 A * 9/1983 Tatum ..... H01L 21/4842 174/536
6,672,886 B2 * 1/2004 Billman ..... H01R 13/631 439/751
6,803,255 B2 * 10/2004 Davis ..... H01L 21/4842 257/666
9,153,920 B2 * 10/2015 Kamei ..... H01R 24/60
9,281,604 B2 * 3/2016 Zhang ..... H01R 13/506
9,577,387 B2 * 2/2017 Hu ..... H01R 13/6597
2017/0294753 A1 * 10/2017 Wu ..... H01R 43/16

* cited by examiner

*Primary Examiner* — Minh N Trinh
(74) *Attorney, Agent, or Firm* — Locke Lord LLP; Tim Tingkang Xia, Esq.

(57) ABSTRACT

The present invention relates to a manufacturing method for an electrical connector, comprising the following steps: providing a first strip, a second strip, and a plurality of grounding terminals, power terminals and signal terminals which are located between the first strip and the second strip; forming a first body and a second body onto the grounding terminals, the power terminals and the signal terminals by insert-molding, wherein each grounding terminal comprises an exposed upper contacting portion, an exposed lower contacting portion and a first connecting portion located between the first body and the second body; bending the first connecting portions, assembling a shielding plate into the accommodating space; and forming an insulation block onto the first body and the second body by an insert-molding.

11 Claims, 6 Drawing Sheets

MANUFACTURING METHOD FOR ELECTRICAL CONNECTOR

RELATED APPLICATIONS

The present application claims priority under 35 U.S.C. § 119 to People's republic of China Patent Application No.201610214757X, which was filed on Apr. 8, 2016, the entire contents of which are incorporated herein by reference.

FIELD OF THE INVENTION

The present invention relates to a manufacturing method for an electrical connector, in particular to a manufacturing method for an electrical connector which having an improved grounding terminals.

BACKGROUND

An existing Type C connector comprises an insulation body, a plurality of upper-row terminals and a plurality of lower-row terminals assembled to the insulation body, a shielding plate located between the lower-row terminals and the upper-row terminals, and a shell surrounding the periphery of an insulation body. The upper-row terminals include upper-row grounding terminals, upper-row signal terminals and upper-row power terminals. The lower-row terminals include lower-row grounding terminals, lower-row signal terminals and lower-row power terminals. The shielding plate is located between the upper-row terminals and the lower-row terminals to prevent the electromagnetic interference between the upper-row terminals and the lower-row terminals and enhance a high-frequency transmission of the connector. When the existing Type C connector is manufactured, an upper body is fixed to the upper-row terminals in a form of integral forming, a lower body is fixed to the lower-row terminals in a form of integral forming, and then the upper-row terminals and the lower-row terminals are fixed with the shielding plate. The assembly procedures are complicated, and the cost is increased.

On account of this, it is certainly necessary to provide an improved manufacturing method for an electrical connector, to overcome the defects existing in the prior art.

SUMMARY OF THE INVENTION

Accordingly, an object of the present invention is to provide a cost-saving manufacturing method for an electrical connector.

In order to solve the above technical problem, the present invention provides the following technical solution: a manufacturing method for an electrical connector comprises the following steps: providing a first strip, a second strip, and a plurality of grounding terminals, power terminals and signal terminals which are located between the first strip and the second strip; forming a first body and a second body onto the grounding terminals, the power terminals and the signal terminals by insert-molding, wherein each grounding terminal comprises an exposed upper contacting portion, an exposed lower contacting portion and a first connecting portion located between the first body and the second body; bending the first connecting portions of the grounding terminals, such that an accommodating space is formed between the first body and the second body; assembling a shielding plate into the accommodating space, and crimping the first body to the shielding plate, such that the shielding plate is in contact with the first connecting portions of the grounding terminals; and forming an insulation portion onto the first connecting portions of the grounding terminals and the shielding plate by insert-molding, and forming an insulation block onto the first body and the second body by insert-molding.

Compared with related technologies, the manufacturing method for an electrical connector of the present invention lies in that each grounding terminal is formed by bending a linear wire, such that waste materials is reduced, only once electroplating is needed, and the manufacturing cost of the grounding terminals is reduced; meanwhile, only twice insert-molding processes are needed in the whole assembly process, such that procedures are -reduced, the assembly is simple and convenient, and the manufacturing cost is reduced; in the meantime, each grounding terminal comprises an upper contacting portion, a first connecting portion extending from the upper contacting portion and a lower contacting portion extending from the first connecting portion, wherein the shielding plate is located between the upper contacting portion and the lower contacting portion of the grounding terminal, and the first connecting portion of the grounding terminal is in contact with the shielding plate. Therefore, the crosstalk between the upper-row signal terminals and the lower-row signal terminals is reduced, and a shielding effect is enhanced.

DETAILED DESCRIPTION OF THE PREFERRED EMBODIMENTS

The following description is presented to enable a person of ordinary skill in the art to make and use the various embodiments. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the various embodiments. Thus, the various embodiments are not intended to be limited to the examples described herein and shown, but are to be accorded the scope consistent with the claims.

Figure 1:
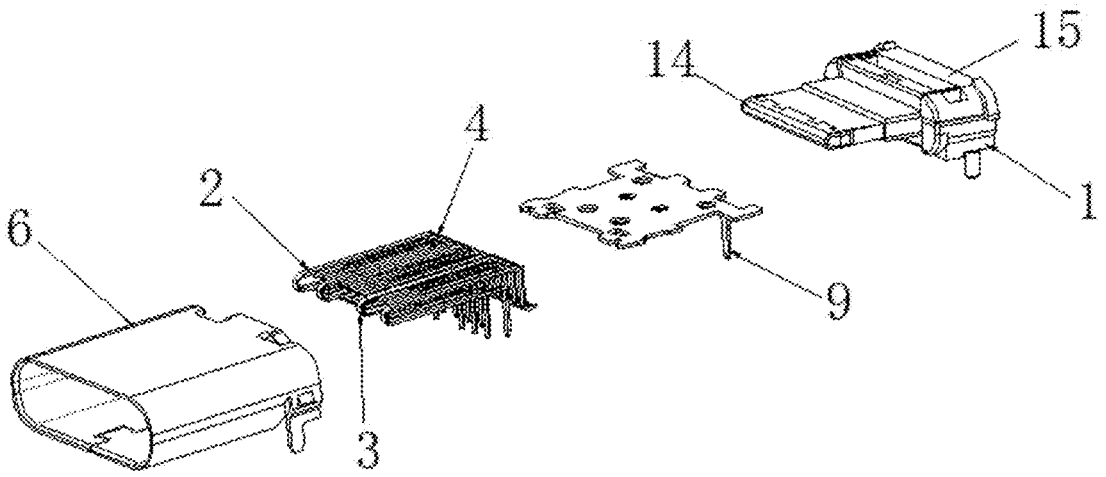
FIG. 1 is an exploded stereogram of an electrical connector of the present invention.
Figure 2:
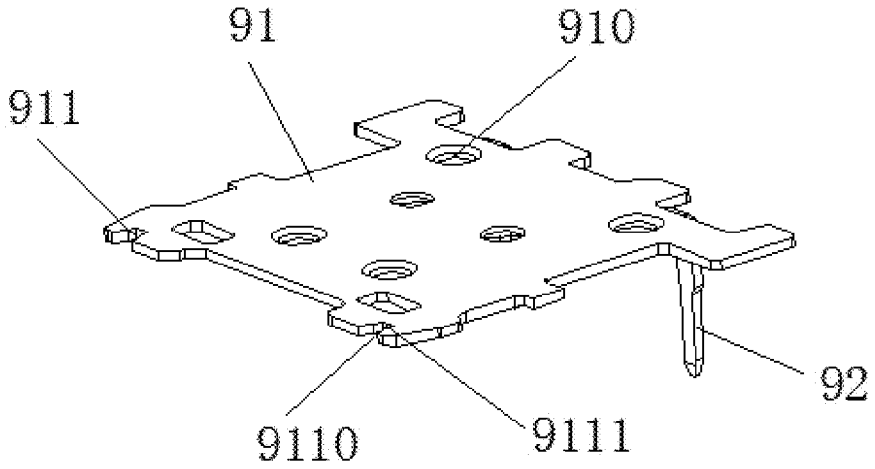
FIG. 2 is a stereogram of a shielding plate of the electrical connector of the present invention.
Figure 3:
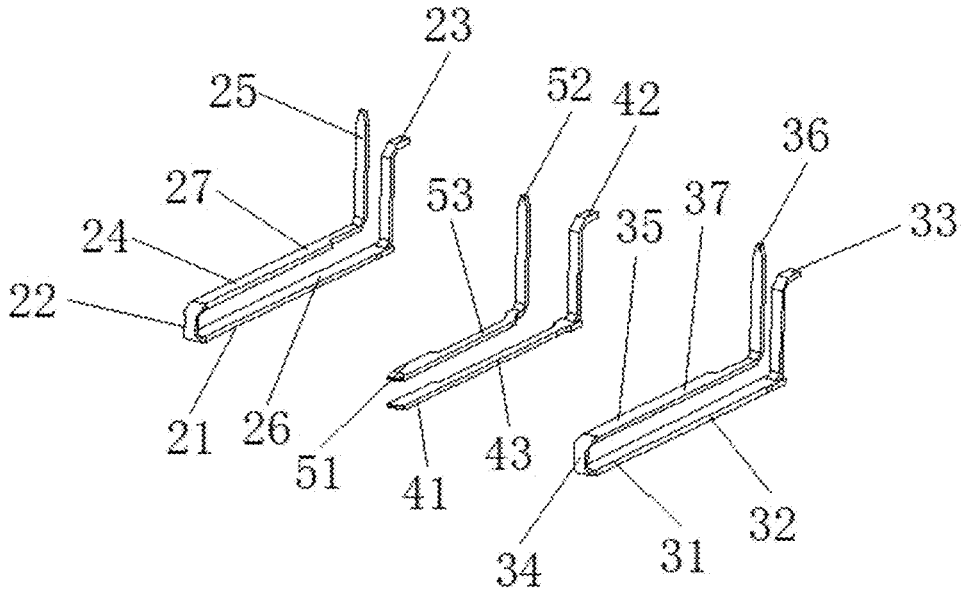
FIG. 3 is a stereogram of grounding terminals, power terminals and signal terminals of the present invention.
Figure 4:
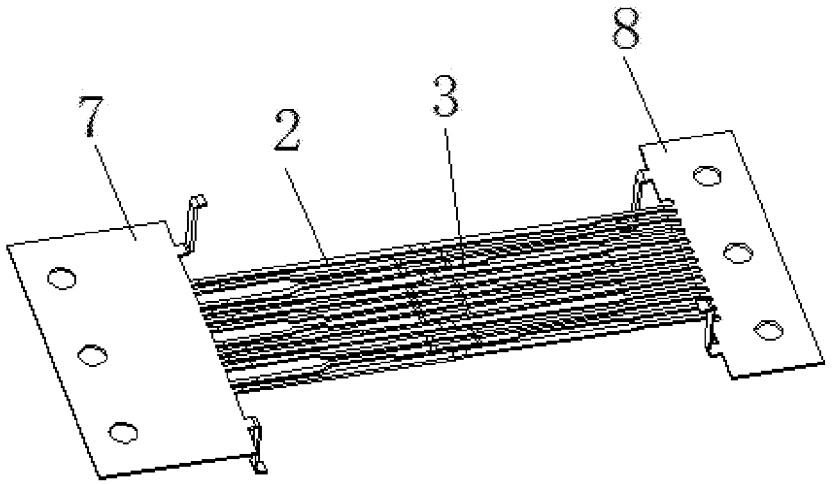
FIG. 4 is a stereogram when the grounding terminals, the conducting terminals and the strips of the electrical connector of the present invention are connected.
Figure 5:
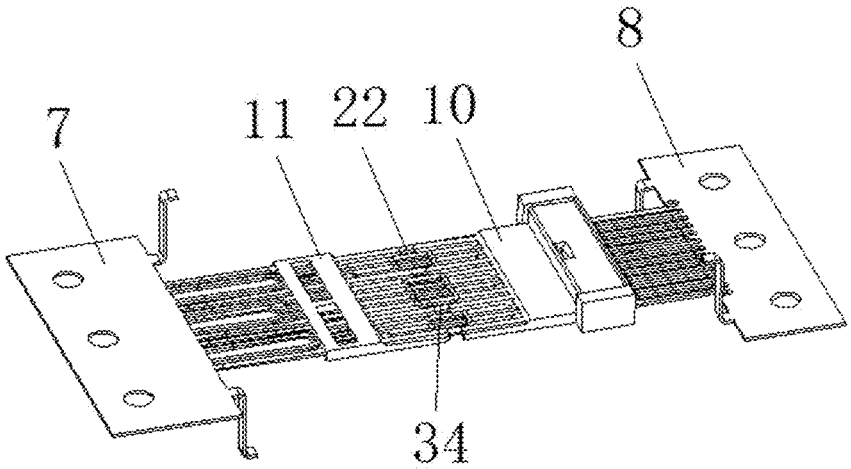
FIG. 5 is similar to FIG. 4, wherein a first body and a second body are insert-molded thereon.
Figure 6:
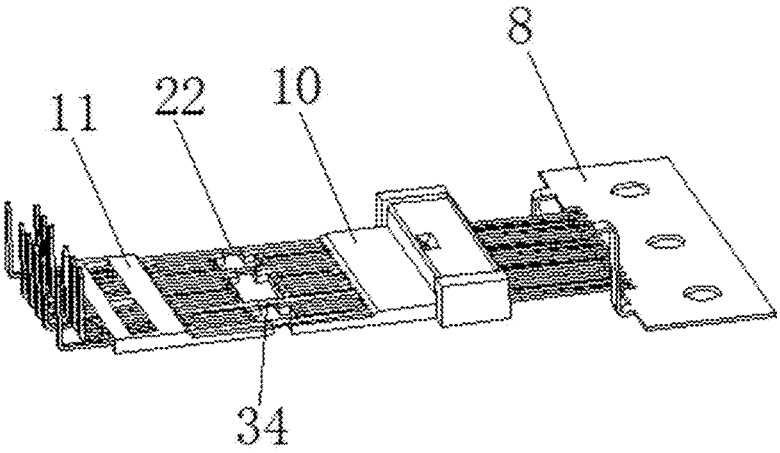
FIG. 6 is similar to FIG. 5, wherein the upper-row signal terminals and the lower-row signal terminals are dis-connected.
Figure 7:
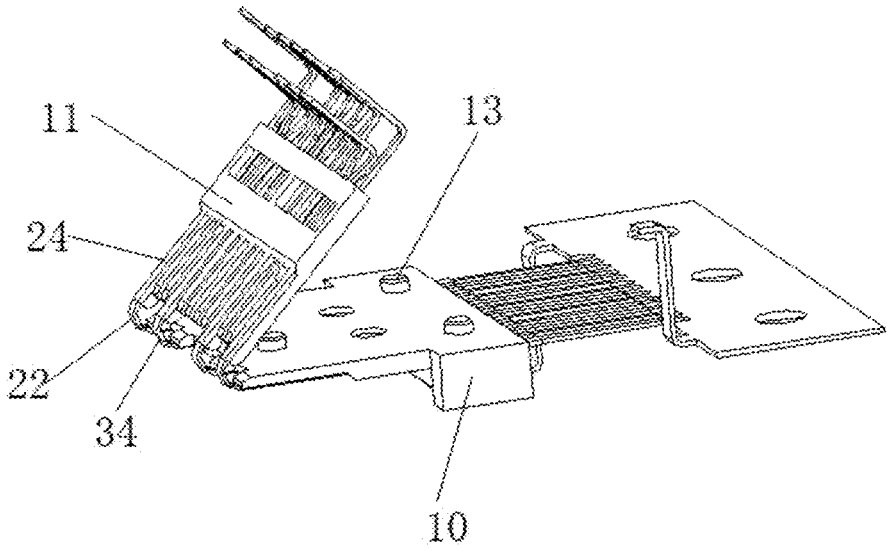
FIG. 7 is similar to FIG. 6, wherein the grounding terminals and the power terminals are bent.
Figure 8:
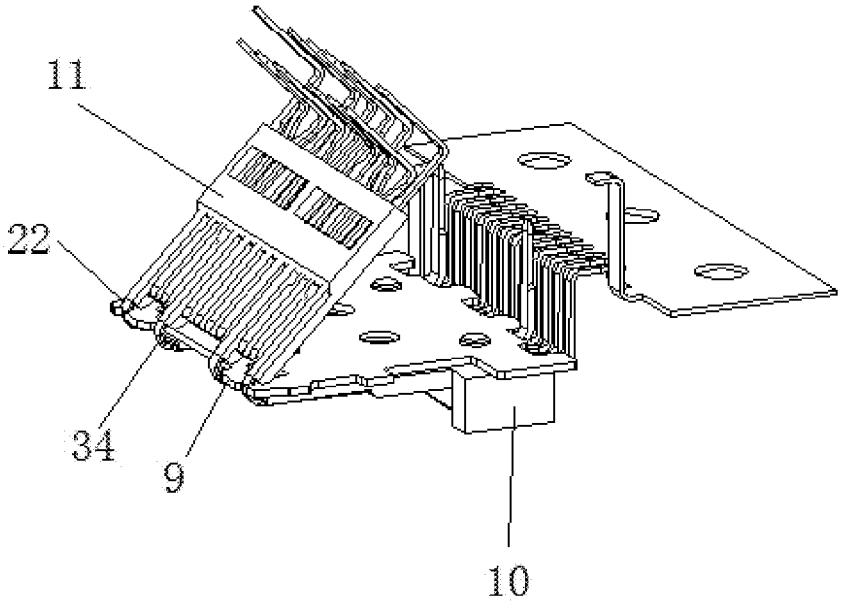
FIG. 8 is similar to FIG. 7, wherein the shielding plate is assembled thereto.
Figure 9:
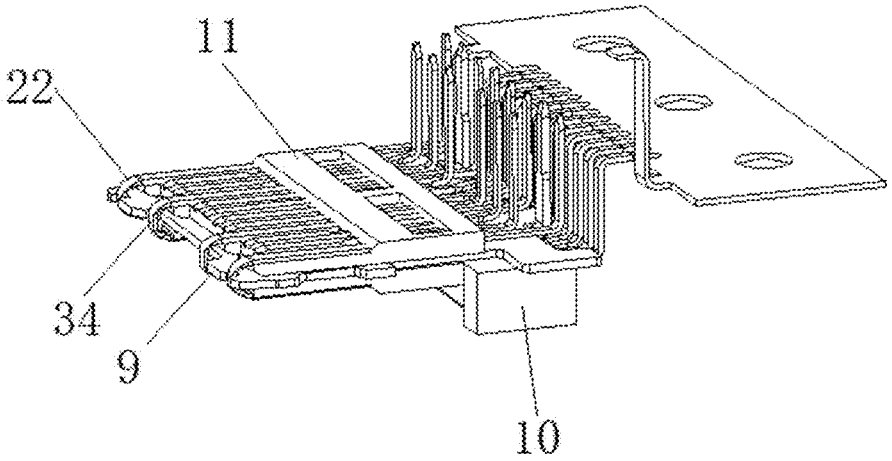
FIG. 9 is similar to FIG. 8, wherein the first body, the shielding plate and the second body are assembled together.
Figure 10:
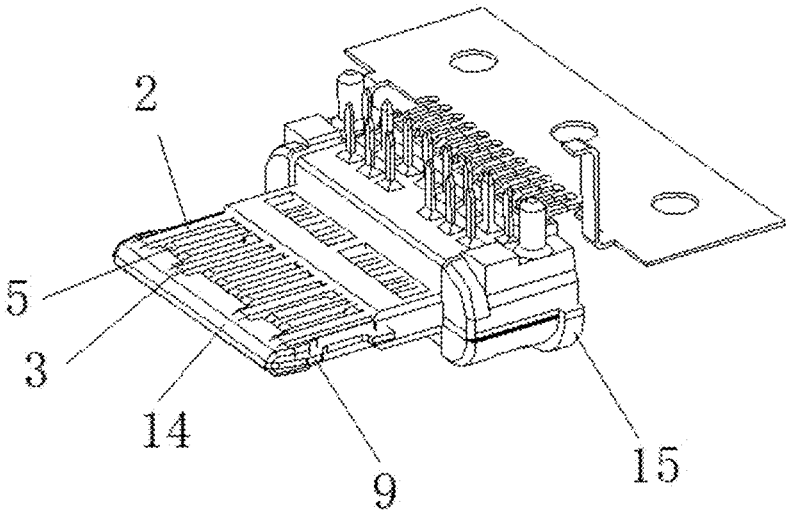
FIG. 10 is similar to FIG. 9, wherein an insulation part and an insulation block are insert-molded thereon.
Figure 11:
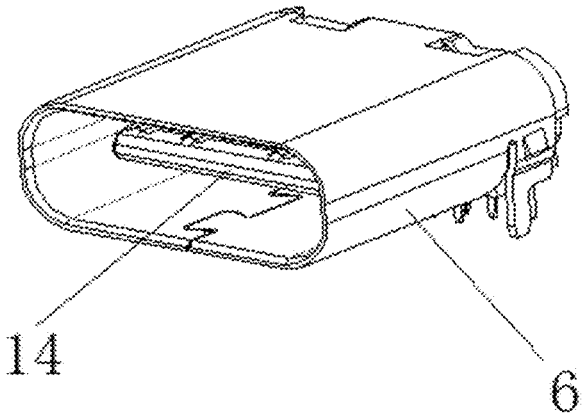
FIG. 11 is is similar to FIG. 10, wherein a shell is assembled thereon.

Referring to FIG. 1 to FIG. 9, an electrical connector of the present invention comprises an insulation body 1, a shielding plate 9, a plurality of grounding terminals 2 and conducting terminals accommodated inside the insulation body 1, and a shell 6 surrounding the periphery of the insulation body 1. The conducting terminals include power terminals 3 and signal terminals. The signal terminals include upper-row signal terminals 4 and lower-row signal terminals 5.

Each grounding terminal 2 is formed by bending a linear wire and comprises an upper contacting portion 21, a first connecting portion 22 and an upper holding portion 26 extending from two opposite ends of the upper contacting portion 21, an upper welding leg 23 extending from the upper holding portion 26, a lower contacting portion 24 extending from the first connecting portion 22, a lower holding portion 27 extending from the lower contacting portion 24, and a lower welding leg 25 extending from the lower holding portion 27, wherein the upper contacting portion 21 is parallel to the lower contacting portion 24. Before each grounding terminal 2 is formed, the upper contacting portion 21, the upper holding portion 26, the first connecting portion 22 and the lower contacting portion 24 of the grounding terminal 2 are located in a same plane. The thickness of the first connecting portion 22 is less than that of the upper contacting portion 21, that of the lower holding portion 27 and that of the lower contacting portion 24, and the width of the first connecting portion 22 is less that of the upper contacting portion 21 and that of the lower contacting portion 24, such that the bending process of the first connecting portion 22 is easier.

Each power terminal 3 is formed by bending a linear wire and comprises a first contacting portion 31, a second connecting portion 34 and a first holding portion 32 extending from two opposite ends of the first contacting portion 31, a first welding leg 33 extending from the first holding portion 32, a second contacting portion 35 extending from the second connecting portion 34, a second holding portion 37 extending from the second contacting portion 35 and a second welding leg 36 extending from the second holding portion 37. Before each power terminal 3 is formed, the first contacting portion 31, the first holding portion 32, the second connecting portion 34, the second holding portion 37 and the second contacting portion 35 of the power terminal 3 are located in a same plane. The thickness of the second connecting portion 34 is less than that of the first contacting portion 31 and that of the second contacting portion 35, and the width of the second connecting portion 34 is less that of the first contacting portion 31 and that of the second contacting portion 35, such that the bending process of the second connecting portion 34 is easier.

Each upper-row signal terminal 4 comprises an upper contacting end 41, an upper fixed portion 43 extending from the upper contacting end 41 and an upper welding portion 42 extending from the upper fixed portion 43. Each lower-row signal terminal 5 comprises a lower contacting end 51, a lower fixed portion 53 extending from the lower contacting end 51 and a lower welding portion 52 extending from the lower fixed portion 53. The shielding plate 9 comprises a main plate 91 and a welding leg 92 extending from the main plate 91. The main plate 91 has a plurality of positioning holes 910 and groove portions 911. The insulation body 1 has positioning pillars 13 fixed with the positioning holes 910. Each groove portion 911 comprises a front groove portion 9110 and a rear groove portion 9111, wherein the width of the front groove portion 9110 is less than that of the rear groove portion 9111, so as to effectively ensure the contact between the first connecting portions 22 of the grounding terminals 2 and the shielding plate 9. The electrical connector of the present invention further comprises an insulation portion 6 which is insert-molded onto the first connecting portions 22 of the grounding terminals 2 and the shielding plate 9, and an insulation block 7 which is insert-molded onto the grounding terminals 2, the conducting terminals and the insulation body 1.

The insulation body 1 comprises a first body 10 and a second body 11. The first body 10 is insert-molded onto the upper holding portions 26 of the grounding terminals 2, the first holding portions 32 of the power terminals 3 and the upper fixed portions 43 of the upper-row signal terminals 4, and the upper contacting portions 21 of the grounding terminals 2, the first contacting portions 31 of the power terminals 3 and the upper contacting ends 41 of the upper-row signal terminals 4 are exposed on the surface of the first body 10. The second body 11 is insert-molded onto the lower holding portions 27 of the grounding terminals 2, the second holding portions 37 of the power terminals 3 and the lower fixed portions 53 of the lower-row signal terminals 4, and the lower contacting portions 24 of the grounding terminals 2, the second contacting portions 35 of the power terminals 3 and the lower contacting portions 51 of the lower-row signal terminals 5 are exposed on the surface of the first body 10.

After the electrical connector of the present invention is assembled, the shielding plate 9 is located between the upper contacting portions 21 and the lower contacting portions 24 of the grounding terminals 2, between the first contacting portions 31 and the second contacting portions 35 of the power terminals 3, and between the upper contacting ends 41 of the upper-row signal terminals 4 and the lower contacting ends 51 of the lower-row signal terminals 5, and the first connecting portions 22 of the grounding terminals 2 are located in the groove portions 911 of the shielding plate 9 and are in contact with the shielding plate 9. Therefore, the crosstalk between the upper-row signal terminals 4 and the lower-row signal terminals 5 is reduced, and a shielding effect is enhanced.

A manufacturing method for an electrical connector of the present invention comprises the following steps:

(1) providing a first strip 7, a second strip 8, and a plurality of grounding terminals 2, power terminals 3 and signal terminals located between the first strip 7 and the second strip 8;

(2) forming a first body 10 and a second body 11 onto the grounding terminals 2, the power terminals 3 and the signal terminals by insert-molding, wherein each grounding terminal 2 comprises an exposed upper contacting portion 21, an exposed lower contacting portion 24, and a first connecting portion 22 located between the first body 10 and the second body 11;

(3) cutting off portions of the signal terminals, which are located between the first body 10 and the second body 11, to form separated upper-row signal terminals 4 and lower-row signal terminals;

(4) bending the first connecting portions 22 of the grounding terminals 2, such that an accommodating space 13 is formed between the first body 10 and the second body 11, wherein the bending angle is 45 degrees;

(5) assembling a shielding plate 9 into the accommodating space 13, and crimping the first body 10 to the shielding plate 9, such that the shielding plate 9 is in contact with the first connecting portions 22 of the grounding terminals 2;

(6) forming an insulation portion 6 onto the first connecting portions 22 of the grounding terminals 2 and the shielding plate 9 by insert-molding, forming an insulation block 7 onto the first body 10 and the second body 11 by insert-molding; and (7) assembling a shell 6 to the insulation block 7.

In this implementation, after the first body 10 and the second body 11 are formed, portions of the signal terminals, which are located between the first body 10 and the second body 11, are cut off to form separated upper-row signal terminals 4 and lower-row signal terminals 5. The present invention is not limited to this, first, portions of the signal terminals, which are located between the first body 10 and the second body 11, may be cut off to form separated upper-row signal terminals 4 and lower-row signal terminals 5, and then the first body 10 and the second body 11 are formed; or disconnected upper-row signal terminals 4 and lower-row signal terminals 5 are directly formed when the grounding terminals 2 and the power terminals 3 are formed. In this implementation, each power terminal 3 comprises an exposed first contacting portion 31 and an exposed second contacting portion 35, and a second connecting portion 34 located between the first body 10 and the second body 11, and the second connecting portion 34 of the power terminal 3 is bent while the first connecting portion 22 of the grounding terminal 2 is bent. The present invention is not limited to this, and the second connecting portions may also be cut off to form the upper-row power terminals and the lower-row power terminals.

The manufacturing method for an electrical connector of the present invention lies in that each grounding terminal 2 is formed by bending a linear wire, such that waste materials are reduced, only once electroplating is needed, and the manufacturing cost of the grounding terminals 2 is reduced; meanwhile, only twice insert-molding are needed in the whole assembly process, such that procedures are reduced, the assembly is simple and convenient, and the manufacturing cost is reduced; in the meantime, each grounding terminal 2 comprises an upper contacting portion 21, a first connecting portion 22 extending from the upper contacting portion 21 and a lower contacting portion 24 extending from the first connecting portion 22, wherein the upper contacting portion 21 is parallel to the lower contacting portion 24, the shielding plate 9 is located between the upper contacting portion 21 and the lower contacting portion 24 of the grounding terminal 2, and the first connecting portion 22 of the grounding terminal 2 is in contact with the shielding plate 9. Therefore, the crosstalk between the upper-row signal terminals 4 and the lower-row signal terminals 5 is reduced, and a shielding effect is enhanced.

It should be noted that the above content is merely the optimal implementations of the present invention, rather than all the implementations. Any equivalent variations made by those common skilled in the art by reading the description of the present invention and the technical solution of the present invention should be covered by the claims of the present invention.

What is claimed is:

1. A manufacturing method for an electrical connector, comprising the following steps:

providing a first strip, a second strip, and a plurality of grounding terminals, power terminals and signal terminals located between the first strip and the second strip;

forming a first body and a second body onto the grounding terminals, the power terminals and the signal terminals by insert-molding, wherein each grounding terminal comprises an exposed upper contacting portion, an exposed lower contacting portion, and a first connecting portion located between the first body and the second body;

bending the first connecting portion of each of the grounding terminals, such that an accommodating space is formed between the first body and the second body;

assembling a shielding plate into the accommodating space, and crimping the first body to the shielding plate, such that the shielding plate is in contact with the first connecting portions of the grounding terminals; and forming an insulation portion onto the first connecting portions of the grounding terminals and the shielding plate by insert-molding, forming an insulation block onto the first body and the second body by insert-molding.

2. The manufacturing method for an electrical connector according to claim 1, wherein in the bending step, a bending angle is 45 degrees.

3. The manufacturing method for an electrical connector according to claim 1, wherein a thickness of the first connecting portion is less than that of the upper contacting portion and that of the lower contacting portion, and a width of the first connecting portion is less than that of the upper contacting portion and that of the lower contacting portion.

4. The manufacturing method for an electrical connector according to claim 1, wherein the shielding plate comprises groove portions, and the first connecting portion of each of the grounding terminals is accommodated in the groove portions and is in contact with the shielding plate.

5. The manufacturing method for an electrical connector according to claim 4, wherein each of the groove portions comprises a front groove portion and a rear groove portion, and the width of the front groove portion is larger than that of the rear groove portion.

6. The manufacturing method for an electrical connector according to claim 1, wherein the shielding plate comprises positioning holes, and the first body or the second body comprises positioning pillars fixed with the positioning holes.

7. The manufacturing method for an electrical connector according to claim 1, further comprising: after forming the first body and the second body, cutting off portions of signal terminals, which are located between the first body and the second body, to form separated upper-row signal terminals and lower-row signal terminals.

8. The manufacturing method for an electrical connector according to claim 1, further comprising: before forming the first body and the second body, cutting off portions of signal terminals, which are located between the first body and the second body, to form separated upper-row signal terminals and lower-row signal terminals.

9. The manufacturing method for an electrical connector according to claim 1, further comprising: after forming the first body and the second body, cutting off portions of signal terminals and power terminals, which are located between the first body and the second body, to form separated upper-row signal terminals and lower-row signal terminals, and separated upper-row power terminals and lower-row power terminals.

10. The manufacturing method for an electrical connector according to claim 1, further comprising: before forming the first body and the second body, cutting off portions of signal terminals and power terminals, which are located between the first body and the second body, to form separated upper-row signal terminals and lower-row signal terminals, and separated upper-row power terminals and lower-row power terminals.

11. The manufacturing method for an electrical connector according to claim 1, further comprising: assembling a shell to the insulation block.

* * * * *